US005734324A

United States Patent [19]

James

[11] Patent Number: 5,734,324

[45] Date of Patent: Mar. 31, 1998

[54] ALARM FOR SLIDING DOORS AND WINDOWS COMPRISING SUCTION PAD

[76] Inventor: William Keith James, 48 Lincoln Avenue, Collaroy, New South Wales 2097, Australia

[21] Appl. No.: 549,695

[22] PCT Filed: May 9, 1994

[86] PCT No.: PCT/AU94/00242

§ 371 Date: Nov. 6, 1995

§ 102(e) Date: Nov. 6, 1995

[87] PCT Pub. No.: WO94/27011

PCT Pub. Date: Nov. 24, 1994

[30] Foreign Application Priority Data

May 7, 1993 [AU] Australia ..... 38498/93

[51] Int. Cl.[6] ..... G08B 13/08

[52] U.S. Cl. ..... 340/546; 340/693

[58] Field of Search ..... 340/546, 693

[56] References Cited

U.S. PATENT DOCUMENTS

| | | | |
|---|---|---|---|
| 3,840,870 | 10/1974 | Norrod | 340/546 |
| 4,100,539 | 7/1978 | Stahl et al. | 340/546 |
| 4,123,752 | 10/1978 | Novotny | 340/545 |
| 4,149,156 | 4/1979 | Blasucci | 340/545 |
| 4,193,067 | 3/1980 | Hawkins | 340/546 |
| 4,266,216 | 5/1981 | Trusty | 340/546 |
| 4,339,747 | 7/1982 | Maybee | 340/547 |
| 4,348,662 | 9/1982 | Fontaine et al. | 340/562 |
| 4,495,486 | 1/1985 | White | 340/546 |
| 4,540,980 | 9/1985 | Porco | 340/546 |
| 4,553,134 | 11/1985 | Holt | 340/546 |
| 4,837,557 | 6/1989 | Striebel | 340/546 |
| 4,888,578 | 12/1989 | Conemac | 340/546 |
| 4,896,139 | 1/1990 | Eldridge | 340/546 |
| 5,022,340 | 6/1991 | Caraba | 116/77 |

*Primary Examiner*—Glen Swann
*Attorney, Agent, or Firm*—Galgano & Burke

[57] ABSTRACT

An alarm and locking device for sliding doors and windows is provided. The device incorporates a suction pad for attachment to a fixed door or window frame adjacent to an edge of the sliding section of the door or window, such that movement of the sliding door or window into contact with the device actuates alarm means associated with the device. The method of attachment of the alarm and locking device employs a flexible suction pad enclosing the lower end of the device, which is applied to the glass panel of the door and then distended at its center by the action of an over-center lever, causing a partial vacuum between the pad and the glass panel.

10 Claims, 2 Drawing Sheets

ALARM FOR SLIDING DOORS AND WINDOWS COMPRISING SUCTION PAD

TECHNICAL FIELD

The present invention relates to alarm devices, and more particularly to alarm devices that are activated upon the opening of a sliding door or other moveable sliding frame.

BACKGROUND ART

One of the consequences of our increasingly crowded urban society has been the inexorably increasing crime rate, the mere threat of which has driven many people to be security conscious. Breaking and entering and burglary, and even physical violence or the threat thereof by intruders, have become increasingly common occurrences, particularly in the case of residential property. Accordingly, the sale and installation of various security systems such as burglar alarms has become a thriving business as many property owners seek to discourage crime to both person and property through the use of such systems.

Professionally installed security systems tend to be quite sophisticated in design and expensive to install. More common are perhaps owner-installed or portable systems of various types which are often installed only on a single door or window. Such systems are popular because they are more economical than the professionally-installed system, and because they can be installed by the home-owner and can usually be removed and taken when the owner of the device moves to another home.

Perhaps the most common window designs are sliding windows, either opening by sliding the moveable window horizontally or vertically to open or close them. Some apartments or home units and homes also have exterior patios with sliding doors, which slide horizontally to open or close. A number of the relatively inexpensive owner-installable security devices, unfortunately do not work with such slidable doors and windows.

The most common door security devices are designed for use with conventionally hinged doors. Movement of the door is designed to trip an alarm and to provide an audible alarm. For example, the device is placed in front of an inwardly opening hinged door, such that when the door is opened, the device will be jarred or tripped over, causing an alarm to be sounded. Examples are disclosed in U.S. Pat. No. 4,540,980 to Porco and U.S. Pat. No. 4,266,216 to Trusty. Other similar devices are designed to be hung from the doorknob, and will react to the door being opened through the use of motion detectors. See for example U.S. Pat. No. 4,100,539 to Stahl, et al. One embodiment of the Stahl, et all device includes a modification for converting the door knob alarm to a sliding window or sliding door alarm by providing a false door knob on a spindle with a small suction cap on the opposite end of the spindle. The suction cap is attached to the fixed glass of the door or window and the alarm device is friction fitted to the false door knob. When the sliding door or window comes into contact with the alarm device, the jarring action causes the alarm to be tripped and sounded.

The most popular type of device which is useable on sliding doors and windows is the bar-type device, which is illustrated in U.S. Pat. No. 4,193,067 to Hawkins, U.S. Pat. No. 4,495,486 to White, U.S. Pat. No. 4,553,134 to Holt and U.S. Pat. No. 4,888,578 to Conemac. The Hawkins device has a rod which operates a mechanical switch, with a detent retaining the rod in a position to continuously operate the switch once initially operated. The White alarm acts as a physical obstruction preventing opening of a sliding door or window until it is removed, at which time the alarm will be sounded.

The Holt device is a spring-loaded bar which may also be installed in a window casing. However, one of the main disadvantages is that the device is not widely adapted to different size window and door frames. The Conemac device is also an elongate bar or rod device which is adjustable in width, but is still required to be manufactured in several different sizes to fit a variety of sizes or door and window openings.

DISCLOSURE OF THE INVENTION

It is an object of the present invention to provide an alarm device which goes at least some way towards overcoming or at least minimizing the prior art problems or limitations outlined above.

It is another object of this invention to provide an improved alarm device which is universally adaptable for use with any type of sliding door or window.

It is a further object of the present invention to provide an alarm device which is relatively simple and readily inexpensive to manufacture.

It is still a further object of the present invention to provide a portable alarm device that may be easily carried and is simple in operation.

These and other objects of this invention will become more apparent from the following descriptions and the drawings.

According to one aspect of this invention there is provided an alarm or alarm and locking device suitable for a sliding door or a sliding window, comprising in combination, a housing, a flexible suction pad, a lower end of the housing being seated upon and enclosed by the flexible suction pad; means, such as lever-operated means disposed on the housing operatively connected to the suction pad and adapted to distend the suction pad to create a partial vacuum between the pad and an underlying surface of the door or window whereby the suction pad can be securely but removably attached to the underlying surface; alarm activating switch means disposed on or adjacent to a peripheral wall of the housing; and electrically-powered signal-creating means (24) and an associated electrical circuit (17) and power source (9) disposed within the housing operatively connected to the alarm actuating switch means whereby power from the power source (9) is supplied by way of the switch means to energise the signal-creating means (24). The signal-creating means (24) may be either an audible alarm or visual alarm means. In some embodiments of the invention, the audible alarm comprises an audio transducer (22) built into the housing. Alternatively it can simply be means to produce an alarm signal at a remote location, such as a monitored security organisation.

BRIEF DESCRIPTION OF THE ACCOMPANYING DRAWINGS

This invention will now be described by way of example only and with reference to the accompanying drawings wherein.

BEST MODE OF CARRYING OUT THE INVENTION

Figure 1:
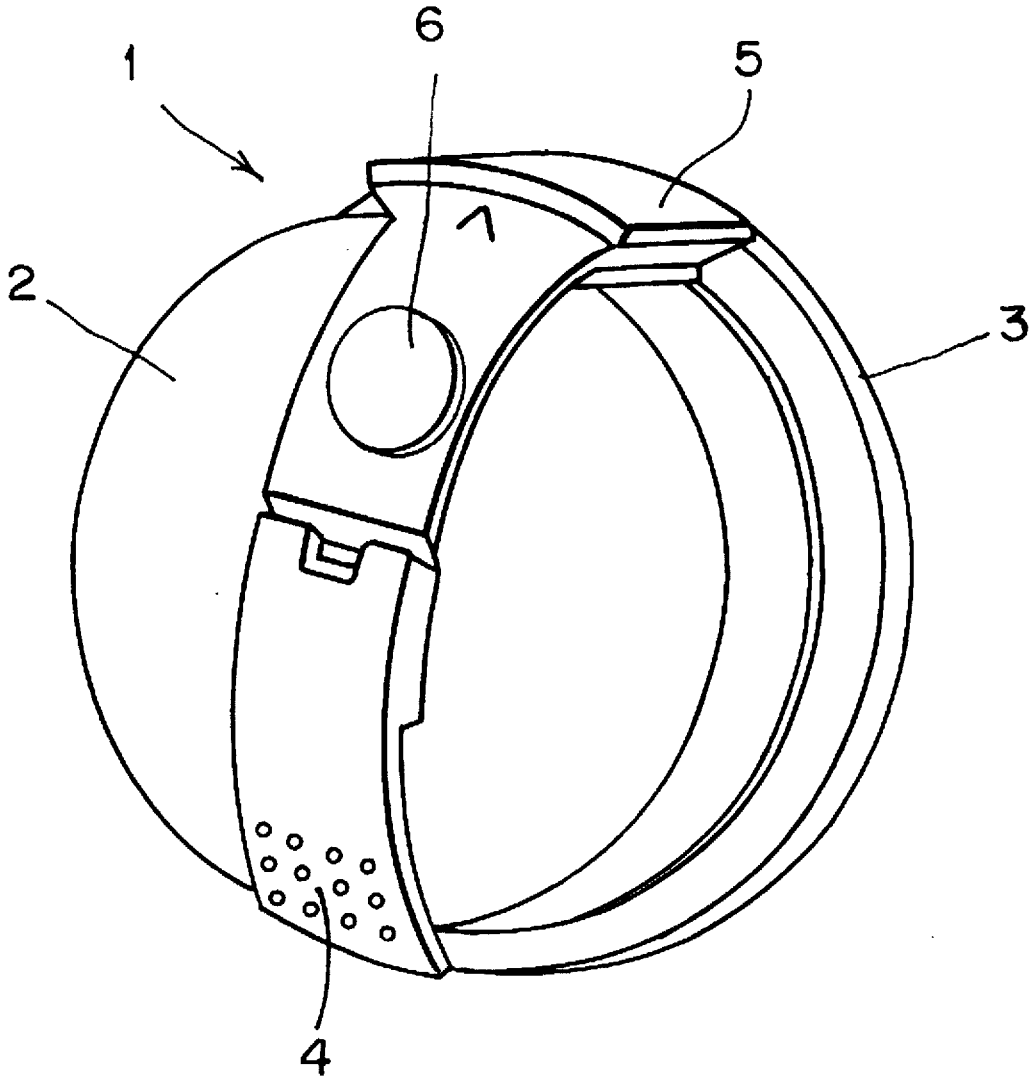
FIG. 1 is a perspective view of an alarm and locking device according to one form of the present invention.
Figure 2:
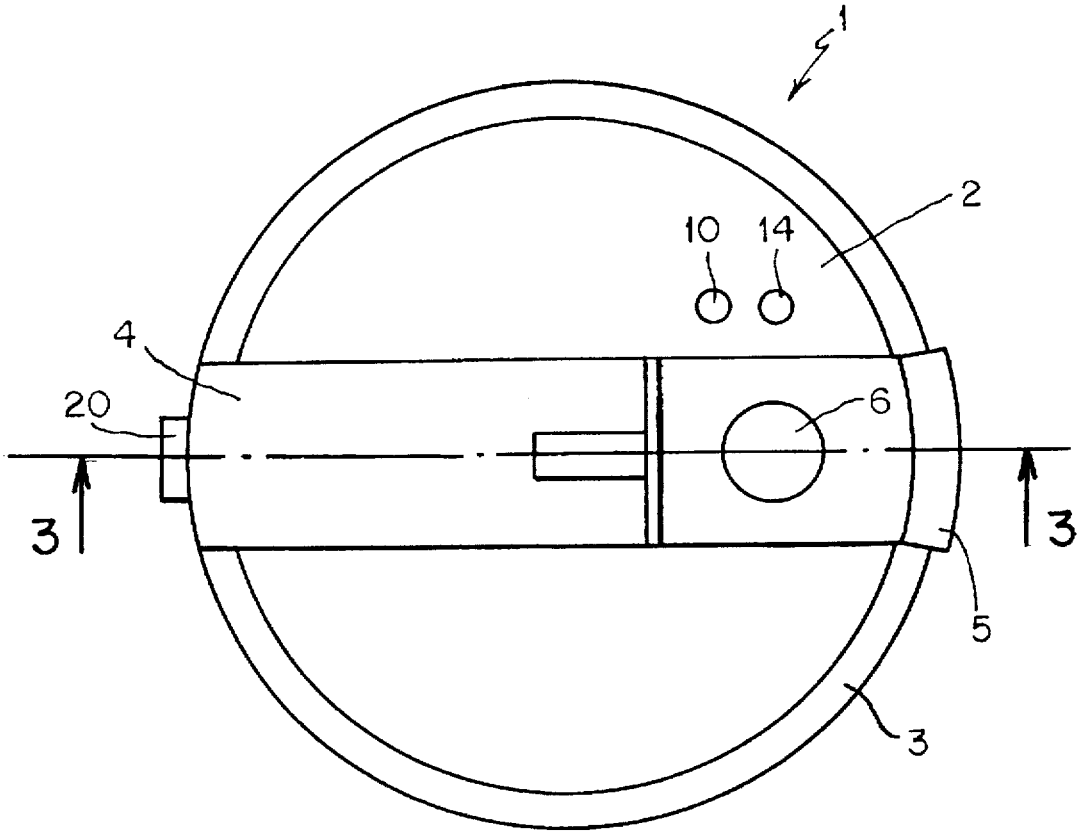
FIG. 2 is a top plan view of the alarm and locking device of FIG. 1.
Figure 3:
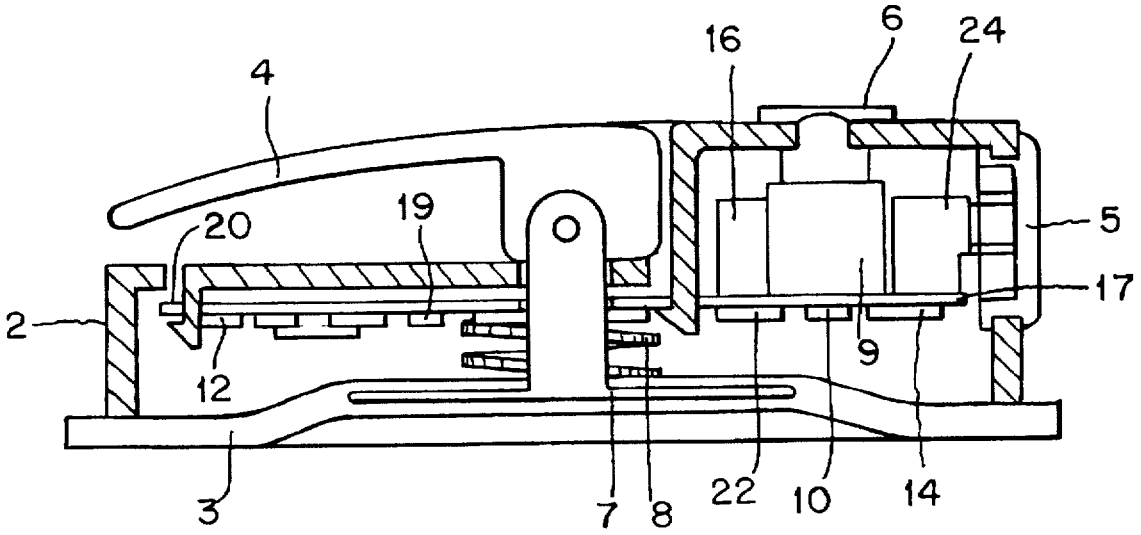
FIG. 3 is a sectional side elevational view of the alarm and locking device of FIGS. 1 and 2, taken along line A—A of FIG. 2.

Referring to FIGS. 1 to 3, there is shown an alarm and locking device 1 in accordance with the present invention that includes a housing or body portion 2. The housing of this embodiment has a domed annular top wall and a depending peripheral wall or skirt. The bottom of the housing is seated on and enclosed by a flexible suction pad 3, which is controlled by an over-centre lever 4, which is operatively connected to the suction pad by means of a piston member 7 which is spring biased by spring means 8.

A push bottom switch 5 is located on the peripheral side wall of the alarm device and is operatively connected to an electrically-powered signal creating device, which can be either an audible or visual signal device or a sending signal (16) which activates a remote burglar alarm.

The housing 2 contains therein a solid state alarm circuit, batteries to power the circuit, and an audio transducer (22) e.g., a piezoelectric buzzer or other device which produces a high volume alarm when supplied with an electrical input from the circuit board to which it is electrically connected. Ideally, the housing has a plurality of small apertures therein to allow the audible signal generated by the buzzer to be propagated into the surroundings.

In use the actuating button or push button 5 is adapted to be operated by the movement of a sliding door or window or other moveable object coming into contact with the button, which in turn electrically closes a switch in the alarm circuit and thus activates the alarm device.

Preferably, the alarm and locking device also includes sensor switch means (13), such as a mercury switch or the like, adapted to actuate the alarm in the event that an attempt is made to move or tamper with the set alarm when in position.

The alarm device of the present invention is of a design which is universal in its ability to be fitted to vertically opening and closing windows as well as horizontally opening and closing doors and windows.

Because of the tenacious, limpet-like, grip provided by the suction cap 3 (which is similar in design to suction cap/handle devices used by glaziers to carry large sheets of glass) the device of the present invention in fact constitutes an easily fitted, non-permanent security alarm and locking device designed to:

A. Prevent a sliding door or window from opening beyond an easily adjusted and infinitely variable preset distance. This distance may be zero where the door or window is closed or, where the door is partially open to allow ventilation, a distance less than that required to allow unwanted or illegal entry. The device is not, however, intended to replace the function of, or the necessity for, standard door locking hardware.

B. To provide either an audible or visual signal or a sending signal to be monitored or acted upon at a remote location when the fitted device is activated when an attempt is made to open the door or window beyond the present point.

The device may conveniently be attached to the interior side of the glazing on the fixed section of the door or window adjacent to the sliding section. This location is not easily accessible from outside the door or window. The method of attachment is physically secure and provides an immovable obstruction to the opening travel of the sliding door or window panel. As described above, preferred embodiments of the device also include sensor switch means (13) adapted to actuate the alarm if any attempt is made to tamper with or to remove the device from its position of attachment to the glass.

The alarm device is moved to the desired position of attachment to the glass with the rubber suction pad 3 in contact with the glass panel. The suction cap is distended at its centre by the action of the over-centre cam lever 4 and the spring biased piston member 7, causing a partial vacuum between the pad and the glass panel. The alarm is set and the alarm circuit is activated by an on/off switch 6. In some embodiments (not illustrated) a green LED (10) indicates when the alarm is activated and a red LED (14) indicates if the alarm has been triggered. A sounding alarm may be shut off by pressing the on/off switch 6.

The alarm is triggered by the sliding door or window striking the push-button switch 5 on the side of the housing of the alarm device. This button may also be operated by hand if using the device as an emergency or 'panic' alarm. When the battery-powered electronic alarm circuit is activated, and the sliding door or window is brought into contact with the push-button switch 5, a loudly audible alarm is triggered and ideally remains on for a preset time (e.g. 5 minutes) and is then automatically reset.

In some embodiments (not illustrated), it is possible to incorporate an optional visual deterrent function. This may simply be a flashing LED visible from the outside of the door or window, or a single flash from a miniature electronic flash tube (20) which is similar to the flash from a photographic flash-gun. The flash is directed towards the glass. The flash unit is housed in a separate housing attached to the side of the alarm housing 2.

Further, in some embodiments (not illustrated), it is possible to incorporate an optional smoke detector (12), which in some circumstances may be convenient because of the portability of the alarm and locking device, and because of the ability to be able to set up and remove the device in any room without requiring tools.

From the foregoing detailed description of the preferred embodiment of the present invention, it is apparent that it provides an alarm and locking device which is conveniently useable on sliding doors and windows. The heavy-duty suction cap of the device makes it possible to prevent a sliding door or window from opening beyond an easily adjusted and infinitely variable preset distance. As such the device acts as a physical obstruction preventing opening of a sliding door or window unless and until the device is removed. When a forced entry is attempted, the device triggers an alarm which continues until the device is reset, with the procedure to reset the alarm device being simple, but requiring access to the alarm device from inside the property.

The alarm and locking device is suitable for use with any size of sliding door or window, and it will work equally well in either vertically opening and closing windows or horizontally opening and closing doors and windows. In addition, the alarm and locking device of the present invention is simple and easy to install without requiring tools for the installation. Installing the device does not damage the door or window, or the casing in which the door or window is mounted. The relatively small size and simple design of the device of the present invention is such that it is unobtrusive when installed so as not to effect a disconcerting presence inside the property.

Because the alarm and locking device of the present invention is portable and is easy to install and to remove without requiring tools, it finds ready application with travellers for use in windows in hotel/motel rooms.

The alarm locking device of the present invention is mechanically simple to ensure reliable operation. The housing, the over-centre lever and the switches are ideally moulded from suitable plastics material, for example, injection moulded glass filled nylon for durability. The suction pad is preferably moulded from suitable synthetic rubber compounds. All electronic parts including switches and battery housing are ideally manufactured as a complete sub-assembly and fitted with integrally moulded 'snap' fasteners inside the housing. The audio transducer (e.g. piezoelectric buzzer) and the optional electronic flash tube are standard off the shelf items.

Although an exemplary embodiment of the present invention has been shown and described, it will be apparent to those having ordinary skill in the art that a number of changes, modifications or alterations to the invention described herein may be made, none of which depart from the spirit of the present invention. All such changes, modifications, and alterations should therefore be seen as being within the scope of the present invention.

It should be appreciated that the present invention provides a substantial advance in alarm and locking devices for sliding doors and windows providing all of the herein described advantages without incurring any relative disadvantage.

I claim:

1. An alarm and locking device for sliding doors and windows comprising in combination, a housing; a flexible suction pad, a lower end of said housing being seated upon and enclosed by the flexible suction pad; means disposed on said housing operatively connected to the suction pad and adapted to distend the suction pad to create a partial vacuum between the pad and an underlying surface of the door or window whereby the suction pad can be securely but removably attached to the underlying surface; alarm actuating switch means disposed on or adjacent to a peripheral wall of said housing; and electrically-powered signal-creating means and an associated electrical circuit and power source disposed within said housing and operatively connected to the said switch means whereby power from the power source is supplied by way of the switch means to the signal-creating means.

2. An alarm and locking device according to claim 1, wherein the means adapted to distend the suction pad comprise lever-operated means disposed on said housing operatively connected to the suction pad.

3. An alarm and locking device according to claim 2, wherein the lever-operated means comprises an over-centre lever operatively connected to the suction pad by means of a piston member having a rod portion pivotally linked at its upper end to said lever and a disc member at is opposite end and affixed to or moulded within the suction pad.

4. An alarm and locking device according to claim 1, wherein the housing comprises a domed annular top wall and a depending peripheral side wall or skirt the lower end of which is seated upon and enclosed by the flexible suction pad.

5. An alarm and locking device according to claim 1, wherein the electrically-powered signal-creating means comprises an audio transducer capable of producing a high volume alarm signal when supplied with an electrical input from the associated circuit and power source.

6. An alarm and locking device according to claim 1, wherein the electrically-powered signal-creating means comprises a transmitter for sending a signal to a remote alarm device.

7. An alarm and locking device according to claim 1, further comprising light-emitting means operatively connected to the power source to indicate that the alarm has been activated or that the alarm has been actuated.

8. An alarm and locking device according to claim 7, wherein the light-emitting means include a flash light directed towards a glass surface of the door or window and visible from the opposite side of said door or window.

9. An alarm and locking device according to claim 1, further comprising sensor switch means adapted to actuate the alarm in the event of physical movement of said device.

10. An alarm and locking device according to claim 1, further comprising a smoke detection device associated with or incorporated into said alarm and locking device.

* * * * *